US010471456B2

(12) United States Patent
Nudelman

(10) Patent No.: US 10,471,456 B2
(45) Date of Patent: Nov. 12, 2019

(54) METHOD OF PAINT BOOTH AIR FEEDING (VARIANTS) AND AIR SUPPLY UNIT TO REALIZE THE METHOD (VARIANTS)

(71) Applicant: Evgeny Shoyl'evich Nudelman, Chernogolovka Mosovaya obl. (RU)

(72) Inventor: Evgeny Shoyl'evich Nudelman, Chernogolovka Mosovaya obl. (RU)

( * ) Notice: Subject to any disclaimer, the term of this patent is extended or adjusted under 35 U.S.C. 154(b) by 300 days.

(21) Appl. No.: 15/674,951

(22) Filed: Aug. 11, 2017

(65) Prior Publication Data

US 2017/0341100 A1 Nov. 30, 2017

Related U.S. Application Data

(62) Division of application No. 13/145,593, filed as application No. PCT/RU2009/000737 on Dec. 28, 2009, now Pat. No. 9,764,347.

(30) Foreign Application Priority Data

Jan. 23, 2009 (RU) ..... 2009102024

(51) Int. Cl.
*B05B 15/00* (2018.01)
*B05B 16/60* (2018.01)

(52) U.S. Cl.
CPC ..... *B05B 16/60* (2018.02)

(58) Field of Classification Search
CPC ..... B05B 16/00; B05B 16/20; B05B 15/40; B05B 16/60

(Continued)

(56) References Cited

U.S. PATENT DOCUMENTS 3,395,972 A 8/1968 Hardison
3,807,291 A 4/1974 Roberts et al.

(Continued)

FOREIGN PATENT DOCUMENTS

BE 1008634 7/1996
BE 1009345 2/1997

(Continued)

OTHER PUBLICATIONS

European Examination Report; dated Mar. 12, 2015 for corresponding EP Application No. EP09838958.8.

(Continued)

*Primary Examiner* — Steven B McAllister
*Assistant Examiner* — Ko-Wei Lin
(74) *Attorney, Agent, or Firm* — Mendelsohn Dunleavy, P.C.

(57) ABSTRACT

Presented are the method of paint booth air feeding to paint with liquid paints (variants) and an air supply unit to realize the method (variants). Said group of innovations consists of two innovations to the method and three innovations to the installation to realize the methods. In the method (variant 1), a closed air stream is created inside the painting booth and air supply unit, after passing the painting zone it is divided into two streams, the first stream returning to the painting booth, while the second stream, containing flammable liquid vapors, is extracted to atmosphere. Simultaneously, some additional air is taken from atmosphere, mixed with return air and supplied to the paint booth painting zone. In the method (variant 2) a closed air stream is created inside the painting booth and air supply unit, and, after passing through the painting zone, is mixed with some additional fresh air and then divided into two streams, the first returning to the painting booth, while the second stream containing flammable liquid vapors, is extracted to atmosphere. The paint- (Continued)

ing booth with separated units of the air supply unit (variants 1 and 2) is intended to realize the method according to claim 1 (FIGS. 1 and 4). The painting booth with connected units of the air supply unit (variants 1 and 2) is intended to realize the method according to claim 1 (FIGS. 2 and 3). The paint booth with air supply unit (variant 3) is intended to realize the method according to claim 2 (FIG. 5). A better performance and improved ecological properties are the immediate technical results of the innovations proposed.

18 Claims, 5 Drawing Sheets

(58) Field of Classification Search
USPC ..... 454/50–55
See application file for complete search history.

(56) References Cited

U.S. PATENT DOCUMENTS

| | | | |
|---|---|---|---|
| 4,537,120 | A | 8/1985 | Josefsson |
| 4,587,927 | A | 5/1986 | Beierling et al. |
| 5,113,600 | A | 5/1992 | Telchuk |
| 5,395,285 | A | 3/1995 | Milton |
| 6,263,485 | B1 | 7/2001 | Schofield |
| 6,264,547 | B1 | 7/2001 | Walti |
| 7,014,338 | B2 | 3/2006 | Pippa et al. |
| 2006/0154594 | A1 | 7/2006 | Ozil |
| 2007/0264928 | A1 | 11/2007 | Chen et al. |

FOREIGN PATENT DOCUMENTS

| | | |
|---|---|---|
| DE | 2710254 | 9/1977 |
| DE | 3408087 | 9/1985 |
| EP | 2047913 | 4/2009 |
| JP | 2009285572 | 12/2009 |
| KR | 100543723 | 1/2009 |

OTHER PUBLICATIONS

Darvin, C.H., et al. "Demonstration of Paint Spray booth Air Recirculation and Flow Partitioning: Design Validation," Air & Waste Management Association 86th Annual Meeting & Exhibition, Colorado, 1983, pp. 1-11.

Thelen, R, "Organic Finishing: Energy Reduction in Paint Booths," Global Finishing Solutions, 2008, 4 pages.

METHOD OF PAINT BOOTH AIR FEEDING (VARIANTS) AND AIR SUPPLY UNIT TO REALIZE THE METHOD (VARIANTS)

TECHNICAL FIELD

This invention relates to industrial manufacturing and is intended for painting and curing objects, e.g. cars after bodyshop repair, when liquid paints are sprayed on.

BACKGROUND ART

Modern technologies of painting objects with liquid paints need air to be blown through the painting booth body by means of Air Supply Units, hereinafter referred to as ASU, to solve several technical tasks, namely:

A) to create a laminar air stream in the painting area with a velocity fast enough to evacuate the paint particle aerosole formed when spraying. The modern requirements for air stream velocity are 20-30 cm/sec, which is fast enough for high quality painting of, for example, car's body;

B) to evacuate vapors of Easy Flammable Liquids, hereinafter referred to as EFL, to a safe level (0.1-0.5 of Low Concentration Limit of Fire Propagation, or Low Explosive Limit, hereinafter referred to as LEL).

At present, one- or two-air fan ASUs are used [1, 2] comprising either an intake or an extract fan (a group of fans blocked), or both an intake and an extract fan (groups of fans) simultaneously which supply air into the painting zone (the painting booth body) in the "Paint" mode and/or extract it from the painting zone. Moreover, these devices simultaneously solve the above-mentioned tasks in the same air stream, i.e. an air stream sufficient to solve task A is fed from atmosphere through the painting zone during the painting process, task B being solved automatically because of a significantly higher air change than is necessary.

The above technological solutions are very simple because of a one-way air stream feed into the working area. Yet, this leads to an excessive consumption of fresh air and energy. Besides, many dispersed dry paint particles with a high content of toxic components combined with solvent vapors are emitted into atmosphere, and these emissions are strictly limited by ecological laws in most countries. Elimination of these contaminants from a significant air volume by means of filtration, sorption or burning requires bulky and expensive installations.

The technological task is therefore to improve the ASU operation in the "Paint" mode in order to decrease the energy costs for air which is supplied to and discharged from the painting zone, as well as it's treatment and subsequent ecological cleaning. The "Baking" mode is similar in all ASUs mentioned and is therefore not considered.

A car painting system and method are known, which comprise a number of consecutively installed painting booths, so that air is supplied from the first booth to the second, then third etc, until LEL is reached, with subsequent cleaning and/or extraction to atmosphere. The above painting system comprises several ASUs, fans, particle separator units, air valves etc. according to the number of painting booths in the system (see U.S. Pat. No. 3,807,291).

This method cannot be applied to a single object painting, a car or its parts after repair, in particular, and is intended for use in a number of automatic (or semiautomatic) painting booths in conveyor manufacturing lines.

There exists a method to feed air into a conveyor installation and a painting booth for this method which involves separation of the painting booth into a number of consecutive partitions when air into/from each partition is fed by separate fans through separate particle cleaners and the burning of EFL vapor follows the exit from the last partition (see U.S. Pat. No. 4,587,927).

Said method can only be used in conveyor automatic painting lines, and the conveyor painting booth is very complicated and not cost-effective, as it requires a great number of fans, particle cleaners, air valves etc. according to the number of partitions inside the painting booth.

The existing inventions require a significant volume of fresh air, which is equivalent to the standard way of paint booth air feeding (more than 20000 cubic meters per hour, as a rule). Solution of the task, i.e. more economical energy consumption in this group of innovations is based on the principle that when air is routed from one consecutive zone of the painting booth to the next, we use air that has already been heated in the previous zone, the energy consumption being thus lowered, but the air is still routed one-way and not returned to the previous zone, which means that the total amount of air volume has to be cleaned before being discharged to atmosphere after the last paint booth in the sequence, which still requires bulky and expensive systems of EFL vapor utilization.

Said methods and installations are used in conveyor painting lines, where the manufacturing volume is considerable and the technological process does not involve human labor. They are economically ineffective, however, for painting single objects on a small scale as well as for bodyshop repair, in absence of conveyor and when human presence in the painting booth is necessary. The bodyshop repair, for instance, involves painting of an immobilized car, and only one painting booth is usually available.

A painting booth for spray coating and a circulation system for the working area, and the method of air supply to paint booth (publication number WO 98/2808 of 2, Jul. 1998 under PCT application PCT/CH 97/00468 of 15, Dec. 1997), are much closer, in principle, to the method and installation proposed to realize the method.

Said method uses ASU to supply air from and discharge it back to atmosphere.

Said spray coating painting booth and circulation system for the working area include ASU to supply to and extract air from the booth. ASU comprises return air treatment and intake units connected together, as well as air ducts, an air regulation unit, hereinafter referred to as ARU, to extract air, ARU to feed air, recirculation and intake fans.

Said method and installation are not very reliable due to their complexity because the painting booth's working area, to realize the above method, has to be divided into multiple zones, namely: a paintwork zone, extraction zones and used air recirculation zone(s) combined with air stream regulation and/or stop air devices with their control units, fresh air feeding zone with separate stream regulation and/or stop air devices with their control units, up to 12 devices in all, let alone filters, light devices, a complicated installation to mechanically move objects being painted on the working area floor and ASU which is divided into sections to separately supply fresh and return air into the booth and extract it.

Exploitation of the above-mentioned painting booth and ASU is complicated because it is necessary to control/operate numerous air valves, which distracts the staff from the paint process and increases the time of fresh paint layer exposition to air stream before curing, which increases a possible deposition on the fresh painted surface. Different air supply zones in the booth's body and, consequently, different air flow volumes, also lead to a number of negative effects, in particular:

1) Low fire safety because of EFL accumulation in the main ASU volume and paint booth's body in the absence of fresh air feeding to those zones.

2) Formation of boundary turbulent air flows between fresh and recirculated air streams because of their different velocities, which leads to paint dispersed particles flying inside the booth and their subsequent potential deposition on the fresh painted surface.

SUMMARY OF THE INVENTION

The technical effect of the group of innovations proposed is improved performance due to a simplified air feeding into the working zone and a simplified ASU design, as well as a higher quality of the painting surface because a uniform (laminar) air flow over the whole area of the painting booth is provided, which allows both the whole of the car (or any other bulky object) and its separate parts to be painted.

Said technical effect, in part of the method, is achieved (according to variant 1) by the method of paint booth air feeding characterized in that fresh air is fed from and extracted into atmosphere by means of ASU, thereby creating a closed air stream in the painting booth and ASU, whereupon said stream is divided into two after passing the painting zone, the first stream returning to the painting booth either with or without filtering, while the second flow with EFL vapors is extracted to atmosphere, simultaneously an additional fresh air intake is provided from atmosphere, mixed with return air and supplied into the painting zone.

Besides, the second flow with EFL vapors is either cleaned of EFL vapors by sorption or burning or is directly extracted to atmosphere.

Said technical effect, in part of the method, is achieved (according to variant 2) by the method of paint booth air feeding characterized in that fresh air is fed from and extracted into atmosphere by means of ASU, thereby creating a closed air stream in the painting booth and ASU, whereupon said stream, after passing the painting zone, is mixed with additional fresh air taken from atmosphere, and is then divided into two streams, the first being fed to the painting booth either with or without filtering, while the second stream with EFL vapors is extracted to atmosphere.

Besides, the second stream with EFL vapors is either cleaned of EFL vapors by sorption or burning or is directly extracted to atmosphere.

Said technical result is achieved, in part of the device, due to the fact that ASU for air supply and extraction from the booth (variant 1) comprising a return air treatment unit and an intake unit connected, as well as air ducts, ARU to extract air, ARU to take in fresh air, recirculation and intake fans, has been engineered with return air and fresh air stream mixing zone connected with the painting booth and located either inside the painting booth between the return air treatment unit and intake unit, or above the return air treatment and intake air units.

Said technical result is achieved, in part of the device, due to the fact that ASU for air supply and extraction from the booth (variant 2) comprising a return air treatment unit and an intake unit connected with each other, as well as air ducts, ARU to extract air, ARU to take in fresh air, recirculation and intake fans, has been engineered with return air and fresh air stream mixing zone connected with the painting booth and located either inside the painting booth between the return air treatment unit and intake unit, or above the return air treatment and intake air units, and a partition to divide the return air treatment units internal volume into zones fitted in the return air treatment unit and constructed as two connected parts, the lower part being made air proof and the upper having holes for return air.

Besides, according to variant 2, the partition to divide the internal volume of return air treatment unit into zones in ASU for air supply and extraction from the booth creates a suction zone, a pressure zone and either a cleaning or a recirculation zone connected with the air stream mixing zone.

Said technical result is achieved, in part of the device (according to variant 3), due to the fact that ASU for air supply and extraction from the booth containing a return air treatment unit connected with the intake unit, air ducts, ARU to extract air, ARU to take in fresh air as well as a recirculation fan, has been engineered with a return air and fresh air stream mixing zone located inside the return air treatment unit and a partition to divide the return air treatment units internal volume into zones which is placed in the return air treatment unit and made up of two connected parts, the lower being air proof and the upper having holes for return air.

Besides, according to variant 3, the partition to divide the internal volume of return air treatment unit into zones in ASU for air supply and extraction from the booth creates an air stream suction and mixing zone connected with the intake air unit, a pressure zone, and a zone of either cleaning or recirculation connected with the painting booth. ASU is supplied with a by-pass ARU placed in the intake unit.

DESCRIPTION OF EMBODIMENTS

Figure 1:
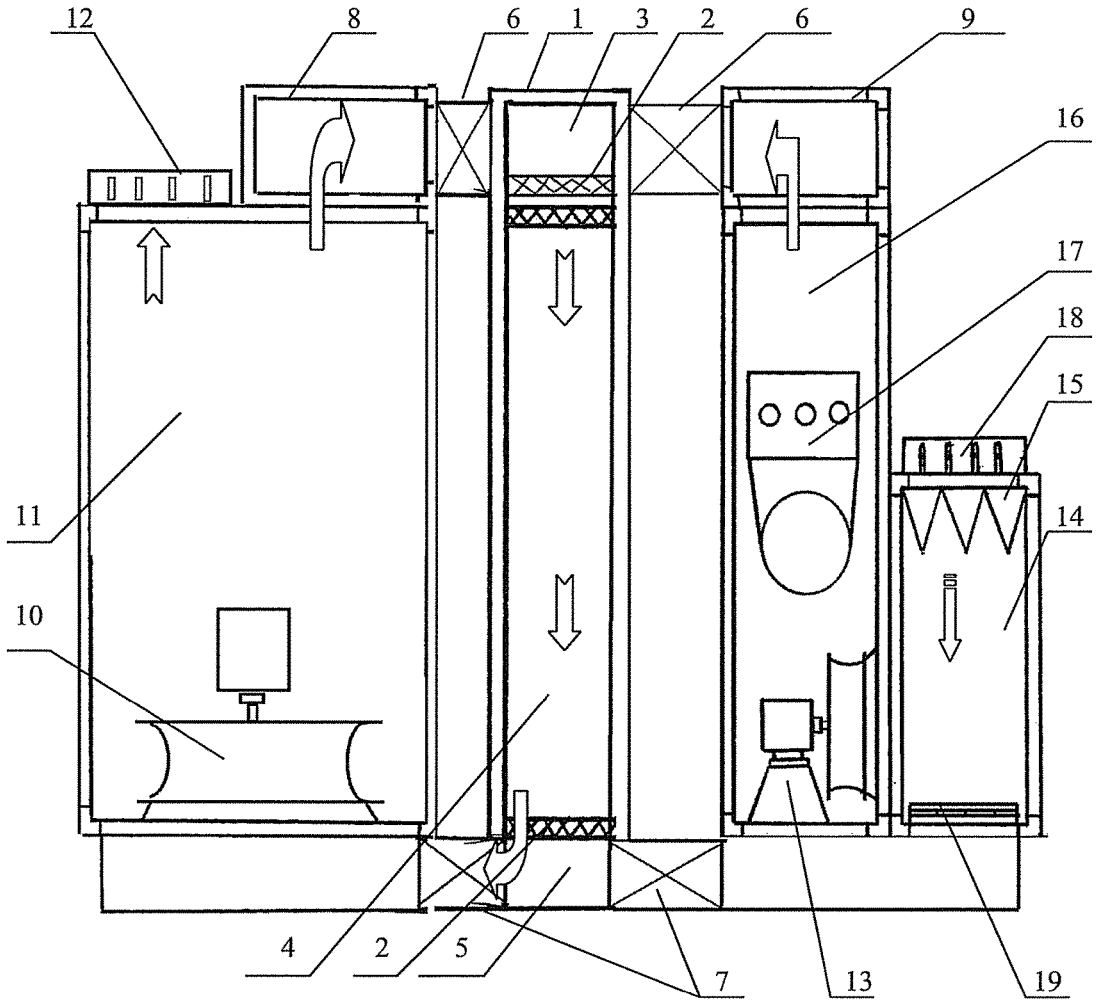
FIG. 1 is a painting booth with ASU having two groups of fans and separated units, general view, variant 1.
Figure 4:
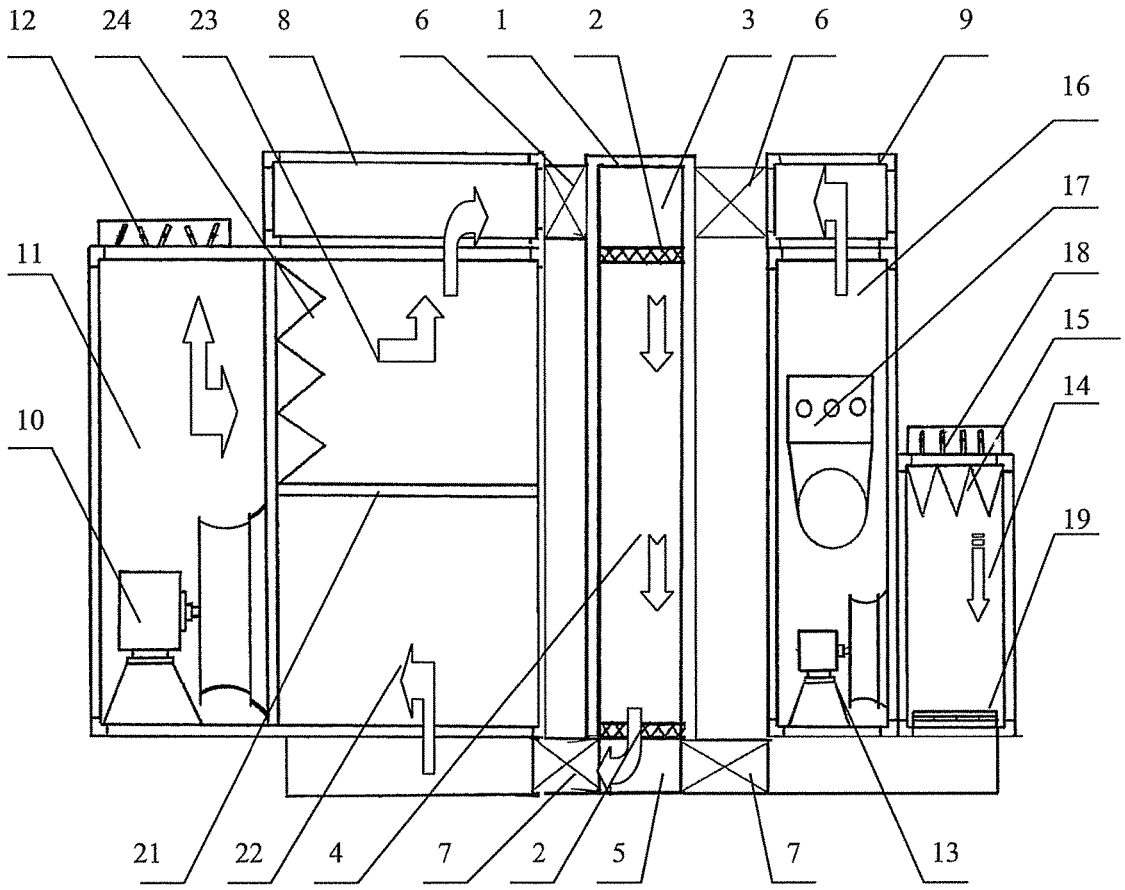
FIG. 4 is a painting booth with ASU having two groups of fans and separated units, general view, variant 2.
Figure 5:
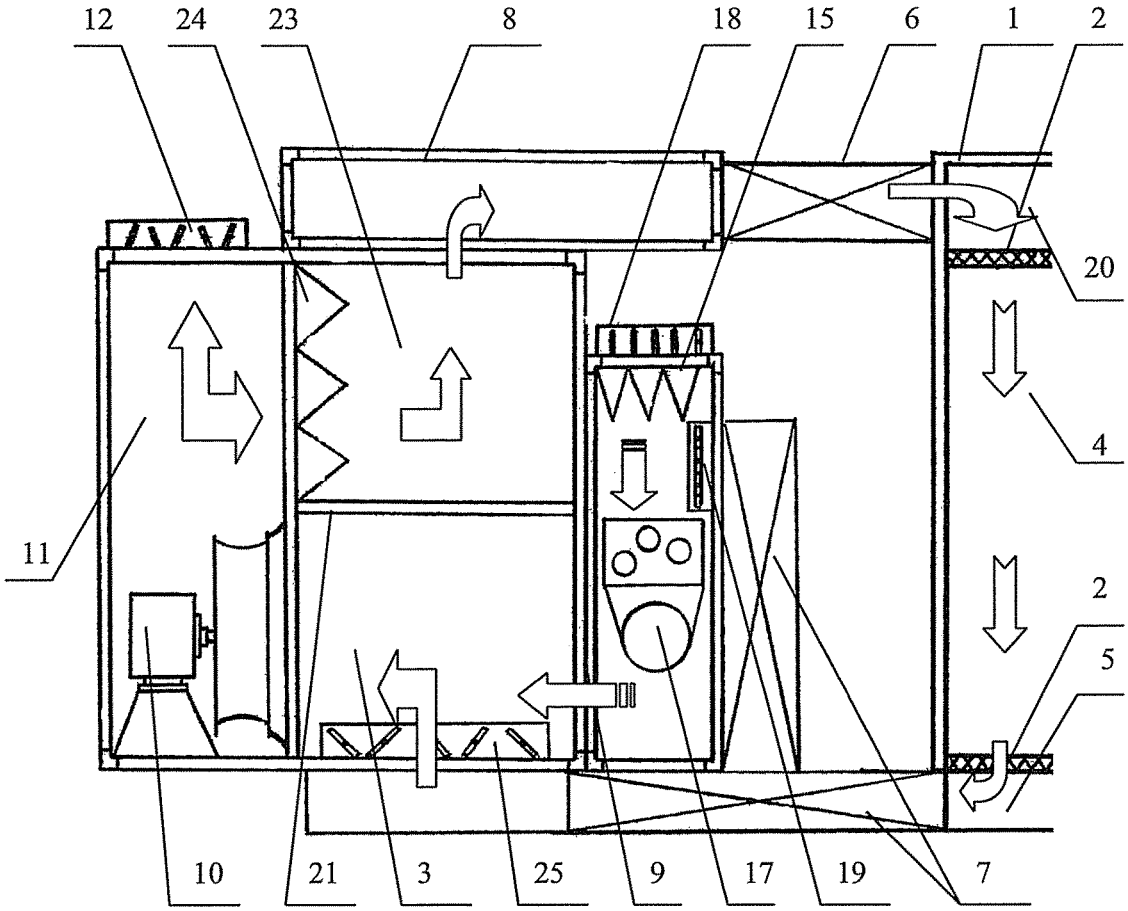
FIG. 5 is a painting booth with ASU having one group of fans, general view, variant 3.

The painting booth with separated units of ASU (Variants 1 and 2 of the method according to claim 1, FIGS. 1 and 4) comprises body 1 with filters 2. Filters 2 divide the painting booth into three zones: zone 3 to mix streams of return (recirculated) air and fresh atmosphere air, zone 4 to paint objects (working zone) where the mixed air stream is supplied from zone 3, and zone 5 to extract used air contaminated with EFL vapors and paint's residue particles. Body 1 of the painting booth is connected by means of supply ducts 6 and extract ducts 7 with ASU which consists of two main units: unit 8 for return air treatment and intake unit 9.

Figure 2:
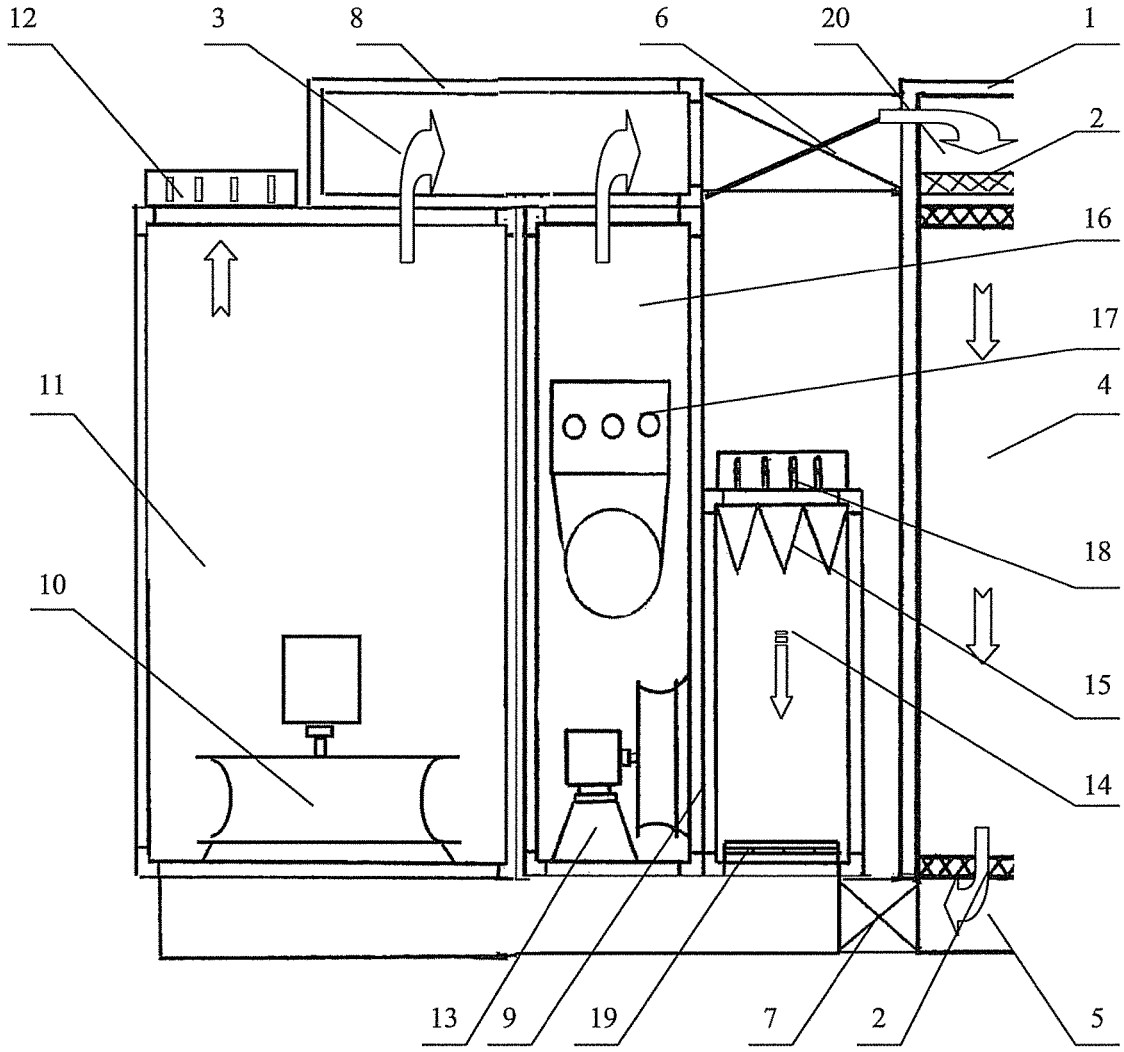
FIG. 2 is a painting booth with ASU having two groups of fans and combined units, general view, variant 1.
Figure 3:
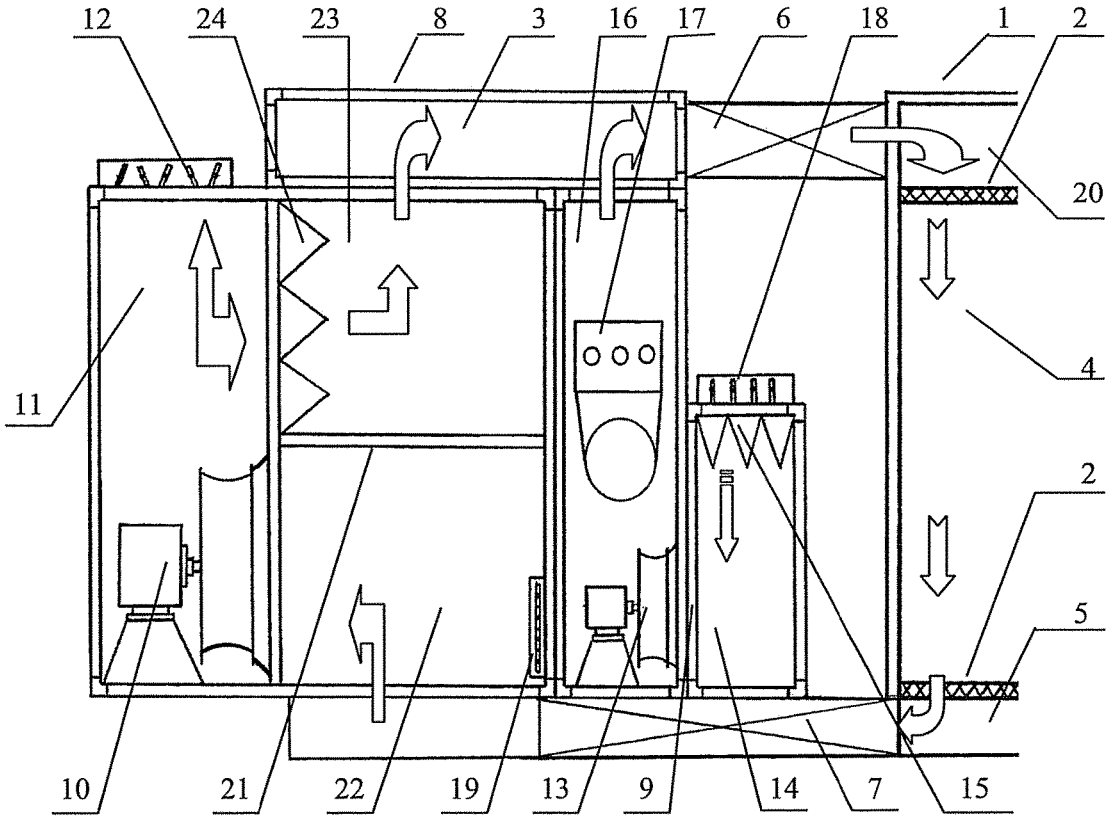
FIG. 3 is a painting booth with ASU having two groups of fans and combined units, general view, variant 2.

The painting booth with combined units of ASU (Variants 1 and 2 of the method according to claim 1, FIGS. 2 and 3) comprises body 1 with filters 2. Filters 2 divide the painting booth into three zones: zone 20 to supply air, zone 4 to paint objects (working zone), and zone 5 to extract used air contaminated with EFL vapors and paint's residue particles. Body 1 of the painting booth is connected by means of supply duct 6 and extract duct 7 with ASU which consists of two main units: unit 8 for return air treatment and intake unit 9.

Unit 8 of ASU (Variant 1 of the method according to claim 1, FIGS. 1 and 2) comprises recirculation fan 10 which creates a closed air stream as well as pressure zone 11 designed to divide used air into two streams, the first returning to the painting zone and creating a closed air stream inside the painting booth and ASU, while the second (with EFL vapors) is extracted to atmosphere by means of ARU 12.

Intake unit 9 comprises intake fan 13 which divides the internal volume of unit 9 into zone 14 responsible for suction and cleaning the fresh air with filters 15 and pressure zone 16, air heater unit 17 being placed either in pressure zone 16 or in suction and cleaning zone 14. Intake unit 9 consists of ARU 18, which provides for the required volume of fresh air. ARU 18 and 12 are coordinated to maintain the necessary air pressure inside body 1 of the painting booth.

Unit 8 of ASU (Variant 2 of the method according to claim 1, FIGS. 3 and 4) comprises recirculation fan 10 to create a closed air stream and partition 21 which divides the internal volume of unit 8 into three zones: suction zone 22, pressure zone 11 and zone 23 to clean or recirculate return air, and zone 3 to mix air streams, connected with the painting booth by means of supply air duct 6. Pressure zone 11 is intended to divide the used air into streams, the first returning to the painting zone which creates a closed air stream inside the painting booth and ASU while the second stream (with EFL vapors) is extracted to atmosphere by means of ARU 12.

Partition 21 consists of two parts, the lower being air proof, the upper having holes for air which goes from pressure zone 11 to cleaning of return air zone 23 where return air is cleaned by filters 24. Filters 24 may be fitted either at the boundary between zones 11 and 23 into the holes of partition 21 or into supply air duct 6, zones 11 and 23 becoming one zone in this case.

Zone 23, where return air is cleaned, is connected with air stream mixing zone 3, the latter being connected with intake unit 9 comprising intake fan 13 which divides unit 9 into zone 14, where fresh air is sucked and cleaned by filters 15, and pressure zone 16, with air heater unit 17 being placed either in pressure zone 16 or in suction and cleaning zone 14.

Intake unit 9 also comprises ARU 18 which supplies the required volume of fresh air. ARU 18 and 12 are coordinated to maintain the required air pressure inside body 1 of the painting booth.

ASU (Variants 1 and 2) can work either in the "Paint" or "Baking" mode. By-pass ARU 19 is fitted either in suction zone 22 of unit 8 (FIG. 3) or in suction zone 14 of unit 9 (FIGS. 1, 2 and 4) to operate in the "Baking" mode.

The painting booth (Variant 3 to realize the method according to claim 2) comprises body 1 with filters 2. Filters 2 divide the painting booth into three zones: zone 20 to supply air, zone 4 to paint objects (working zone), and zone 5 to extract used air contaminated with EFL vapors and paint's residue particles. Body 1 of the painting booth is connected by means of supply duct 6 and extract duct 7 with ASU which consists of two main units: unit 8 for return air treatment and intake unit 9.

Unit 8 of ASU comprises recirculation fan 10 to create a closed air stream and, simultaneously, to suck in fresh air, partition 21 which divides the internal volume of unit 8 into three zones: zone 3 to mix the air streams, pressure zone 11 and zone 23 to clean or recirculate return air. Zone 3 is intended to mix streams of used and fresh air, while pressure zone 11 is intended to divide air into two streams, the first returning to the painting zone which creates a closed air stream inside the painting booth and ASU, the second stream with EFL vapors being extracted to atmosphere by ARU 12.

ARU 25 is fitted into zone 3 to regulate (together with ARU 18 at the intake of unit 9) the proportion of used and fresh air streams supplied by the fan. Partition 21 consists of two parts: the lower is air proof, while the upper is made with holes for air coming from pressure zone 11 to return air cleaning zone 23 where the return air is cleaned by filters 24. Filters 24 can be placed either at the boundary between zones 11 and 23 in the holes of partition 21 or in supply air duct 6, or combined with filters 2 in the supply air zone, zones 11 and 23 being coupled in this case.

Zone 3 is connected with intake unit 9 comprising filters 15 and heater unit 17.

ARU 18 and 12 are coordinated to maintain the required air pressure inside body 1 of the painting booth.

ASU can be operated either in the "Paint" or "Baking" mode. By-pass ARU 19 is provided in fresh air intake unit 9 before heater unit 17 to operate in the "Baking" mode.

MODES FOR CARRYING OUT THE INVENTION

The method of paint booth air feeding to paint with liquid paints (variant 1) can be realized as follows.

To work in the "Paint" mode, the object to be painted is placed in body 1 of the paint booth (zone 4). Both recirculation 10 and intake 13 fans start working simultaneously when ASU is turned on. Some finely dispersed paint particles and EFL vapors, which are trapped in the air stream, are formed in zone 4 when the object is painted. The air stream, due to negative pressure created by fan 10, goes through bottom filters 2 of the booth's body, where paint particles are partially arrested, and then part of the air stream containing EFL vapors and finely dispersed dry paint particles is extracted through ARU 12 to be cleaned and/or exhausted to atmosphere, but the main air stream goes to mix with fresh external air supplied by the intake fan into zone 3, which leads to a decreased EFL vapor concentration and further removal of dust and paint in upper filters 2 of the booth's body. After the filters, the uniform mixed air stream is again supplied to the whole area of working zone 4.

The second stream containing EFL vapors is either cleaned of EFL vapors by sorption or burning, or is directly exhausted to atmosphere.

The method of paint booth air feeding to paint with liquid paints (variant 2) is realized as follows.

To work in the "Paint" mode, the object to be painted is placed in body 1 of the paint booth (zone 4). Fan 10 creates negative pressure in zone 3, which leads to suction of fresh air from atmosphere. This air is cleaned of dust in filter 15 and then goes through heater unit 17 to stream mixing zone 3. The volume of fresh air intake is determined by opening of ARU 18. Recirculation fan 10, due to negative pressure in zone 3, also creates negative pressure in zone 5 whereby air is sucked from the working zone inside the painting booth through paint particle cleaning filters 2. The used air from zone 5 goes through ARU 25 to zone 3 where it mixes with the fresh air stream. The mixed stream is then supplied by fan 10 to zone 11, where it is separated into 2 streams. The first stream, due to pressure of fan 10, goes through filters 24 which can be fitted into holes in partition 21, proceeds through the air duct to the booth's body, where, as it passes through filters 2, it is again supplied as a uniform stream to the whole area of working zone 4 of the booth. The volume of air creating the second stream is determined by ARU 12 opening and is regulated by the operator depending on the amount of excess pressure required in working zone 4 of the painting booth, i.e. a little less than the volume of fresh air supplied.

The second stream containing EFL vapors is either cleaned of EFL vapors by sorption or burning, or is directly exhausted to atmosphere.

The Air Supply Unit to supply and extract air from the booth (variant 1) works as follows.

To work in the "Paint" mode, the object to be painted is placed in body 1 of the paint booth (zone 4). Intake fan 13 creates negative pressure in zone 14 and sucks in fresh air which is cleaned of dust by filter 15 and is then supplied through heater 17 to stream mixing zone 3. The volume of fresh air sucked in is determined by opening of ARU 18. Recirculation fan 10 creates negative pressure in zone 5, whereby air is sucked (extracted) from working zone 4 inside the paint booth by paint particle filters 2. Then, the air is supplied by fan 10 to zone 11, where it is divided into 2 streams. The first stream, cleaned by additional filters (if available) or not cleaned, goes to zone 3 because of pressure of fan 10, where it is mixed with fresh air also supplied under pressure by fan 13 and, when passing through filters 2, is again supplied as a uniform stream to the whole area of working zone 4 of the booth. The volume of air creating the second stream which is exhausted into the cleaning device or atmosphere is determined by ARU 12 opening and is regulated by the operator dependending on how much excess pressure is required in working zone 4 of the painting booth, i.e. a little less than the volume of fresh air supplied.

The Air Supply Unit to supply and extract air from the booth (variant 2) works as follows.

To work in the "Paint" mode, the object to be painted is placed in body 1 of the paint booth (zone 4). Both recirculation 10 and intake 13 fans start working simultaneously when ASU is turned on. Some finely dispersed paint particles and EFL vapors, which are trapped in the air stream, are formed in zone 4 when the object is painted. The air stream, due to negative pressure created by fan 10, goes through bottom filters 2 of the booth's body, where paint particles are partially arrested, and then part of the air stream containing EFL vapors and finely dispersed dry paint particles is extracted through ARU 12 to be cleaned and/or exhausted to atmosphere, while the main air stream goes to fine cleaning filters 24 where additional extraction of finely dispersed paint particles from the return air stream is carried out, and then mixes with fresh external air in zone 3, which leads to a decreased EFL vapor concentration, and finally is further cleaned of dust and paint in upper filters 2. After the filters, the uniform mixed air stream is again supplied to the whole area of working zone 4.

In said variant, internal partition 21 allows additional filters of fine cleaning 24 to be placed in return air treatment unit, which significantly improves the degree of air cleaning compared with variant 1 and lengthens the lifetime of upper filters 2 in the painting booth.

The "Baking" mode (variants 1 and 2) is carried out as follows: the operator opens by-pass ARU 19 and closes ARU 12 and 18 after finishing the painting process. The level of mutual closing of the last two is determined by necessity to maintain some excess pressure in the paint booth body. Fan 13 starts to work in recirculation mode after completing the above steps, sucking air from zone 5 and supplying it through air heater unit 17 to zone 3, which provides fast air heating to the temperature required.

The Air Supply Unit to supply air to the painting booth (variant 3) works as follows.

To work in the "Paint" mode, the object to be painted is placed in body 1 of the paint booth (zone 4). The main (recirculation) fan 10 starts working when ASU is turned on. Fan 10 creates negative pressure in mixing zone 3 and, through it, in intake unit 9, whereby fresh air is sucked from atmosphere and is cleaned of dust by filter 15. It then goes through heater unit 17 to stream mixing zone 3. The volume of fresh air sucked in is determined by opening of ARU 18. Recirculation fan 10 (through zone 3) also creates negative pressure in zone 5 so that air is sucked (extracted) from working zone 4 inside the painting booth through paint particle cleaning filters 2. Used air goes to zone 3 through air duct 7 and ARU 25, where it is mixed with a fresh air stream. The stream ratio is regulated by the degree of mutual opening of ARUs 18 and 25. Then, the mixed air stream is supplied by fan 10 to zone 11, where it is separated into 2 streams. The first stream, due to pressure of fan 10, passes through filters 24 installed in partition 21 and goes to zone 23, then, through air duct 6, to zone 20 of the booth, where, after passing through cleaning filters 2 under pressure of fan 10, it is again supplied as a uniform stream to the whole area of working zone 4 of the booth. The volume of air creating the second stream is determined by ARU 12 opening and is regulated by the operator depending on the amount of excess pressure required in working zone 4 of the painting booth, i.e. a little less than the volume of fresh air supplied.

The "Baking" mode goes as follows: the operator opens by-pass ARU 19 and closes ARUs 12 and 18 after finishing the painting process. The level of mutual closing of the last two is determined by necessity to maintain some excess pressure in the paint booth body. ARU 25 is partly closed to increase the volume of air going through the air heater. Fan 10 starts operating in a full recirculating mode after completing the above steps: it sucks air from zone 5 and supplies it through air heater unit 17 to zone 4 of the booth, which provides fast air heating to the temperature required.

INDUSTRIAL APPLICABILITY

Application of the group of innovations proposed leads to:

a) lower investment costs because of a simplified engineering design of the air units;

b) improvement of exploitation properties because of a lower energy consumption when moving and heating the air;

c) improved ecological properties because less atmospheric air is consumed and its subsequent complete cleaning before exhaust to atmosphere is facilitated.

Cited Documents (See Page 1)

[1]—USA patent U.S. Pat. No. 5,395,285, B05B15/12, 1995 Mar. 7.

[2]—German patent DE3408087, B05B15/12, 1985 Sep. 5.

What is claimed is:

1. An air supply unit for feeding and extracting air from a painting booth, wherein the air supply unit comprises a return air treatment unit configured to provide an air stream to be returned to the painting booth by the air supply unit at the same time that paint is supplied to an object located in the painting booth to paint the object, the return air treatment unit having a housing and a partition that divides an internal volume defined by said housing into a mixing zone, a high pressure zone and a recirculation zone, said partition configured to permit air to flow from said mixing zone to said high pressure zone, and configured to permit air to flow directly from said high pressure zone to said recirculation zone and said partition including a solid portion configured to prevent air from flowing directly from said mixing zone to said recirculation zone, and a first air duct operably connected to the painting booth and said mixing zone of the return air treatment unit for transporting used air from said painting booth to said mixing zone of said return air treatment unit and a second air duct operably connected to the recirculation zone and the painting booth for returning said airflow to the painting booth, an intake unit fluidly connected to a mixing zone of the return air treatment unit, said intake unit being configured to provide fresh air to said mixing zone at the same time that paint is supplied to an object located in the painting booth to paint the object, said mixing zone being configured for mixing said used air exiting from the first air duct and fresh air exiting from the intake unit into an airflow for return to the painting booth, one or more filters located between said high pressure zone and said recirculation zone so that air flowing from the high pressure zone to the recirculation zone passes through said one or more filters;

an air regulation unit operably connected to the high pressure zone to extract air from said high pressure zone of said return air treatment unit, a second air regulation unit operably connected to the intake unit to take in fresh air for supply to said intake unit, and a recirculation fan and a recirculation fan housing are attached to the partition and are located to create suction in said mixing zone of said return air treatment unit and high pressure in said high pressure zone of said return air treatment unit so that a portion of the air in the high pressure zone is fed to the recirculation zone and said portion of the air leaves the return air treatment unit via the recirculating zone.

2. The air supply unit of claim 1, wherein the partition divides the return air recirculation unit into a mixing compartment enclosing the mixing zone, a high pressure compartment enclosing the high pressure zone and an air recirculation compartment enclosing the air recirculation zone.

3. The air supply unit of claim 1, wherein the partition is substantially T-shaped.

4. The air supply unit of claim 1, wherein the recirculation fan is configured to create a negative pressure in the intake unit whereby fresh air is drawn into the intake unit from atmosphere.

5. The air supply unit of claim 4, wherein intake unit further comprises a filter located to clean air drawn into the intake unit from atmosphere.

6. The air supply unit of claim 1, wherein the recirculation fan is configured to create a negative pressure in the first air duct whereby air is drawn from a working zone inside the painting booth into the first air duct.

7. The air supply unit of claim 1, further comprising an additional air regulation unit operably connected to the first air duct to regulate flow of air from said first air to said mixing zone.

8. The air supply unit of claim 1, wherein the recirculation fan is configured to create a negative pressure in the intake unit whereby fresh air is drawn into the intake unit from atmosphere and the recirculation fan is configured to create a negative pressure in the first air duct whereby air is drawn from a working zone inside the painting booth into the first air duct.

9. The air supply unit of claim 8, further comprising an additional air regulation unit operably connected to the first air duct to regulate flow of air from said first air duct to said mixing zone.

10. The air supply unit of claim 9, wherein intake unit further comprises a filter located to clean air drawn into the intake unit from atmosphere.

11. A method of paint booth air feeding in painting mode with liquid paints employing the apparatus of any one of claims 1-10, comprising the steps of:

feeding air from atmosphere and exhausting air to atmosphere by means of an air supply unit, creating a closed air stream inside the painting booth and air supply unit during painting mode, taking in air from the atmosphere, mixing the air in the mixing zone with said closed air stream prior to dividing said closed air stream into first and second streams, subsequently dividing said closed air stream into the first and second streams, returning the first stream to the painting booth during painting mode as a laminar airflow, either with or without filter cleaning, and either cleaning the second stream by sorption or burning or directly exhausting the second stream, containing vapors of flammable liquids, to atmosphere.

12. The method of claim 11, further comprising a step of creating a negative pressure whereby fresh air is taken in from atmosphere.

13. The method of claim 12, further comprising a step of filtering air taken in from atmosphere.

14. The method of claim 11, further comprising a step of creating a negative pressure whereby said closed air stream is drawn from a working zone inside the painting booth.

15. The method of claim 11, further comprising a step of regulating flow of said closed air stream to said mixing step.

16. The method of claim 11, further comprising a step of regulating flow of said air from atmosphere to said mixing step.

17. The method of claim 11, further comprising steps of:

creating a negative pressure whereby fresh air is taken in from atmosphere, creating a negative pressure whereby said closed air stream is drawn from a working zone inside the painting booth, and regulating flow of said closed air stream to said mixing step.

18. The method of claim 17, further comprising a step of: filtering air taken in from atmosphere.

* * * * *